US006953125B2

(12) United States Patent
Mingot et al.

(10) Patent No.: US 6,953,125 B2
(45) Date of Patent: Oct. 11, 2005

(54) HIGH ENERGY SHOCK ABSORBING WALL STRUCTURE AND CONTAINER USING SAME

(75) Inventors: David Mingot, Pessac (FR); Dominique Poirier, Gujan-Mestras (FR)

(73) Assignee: Commissariat a l'Energie Atomique, Paris (FR)

( * ) Notice: Subject to any disclaimer, the term of this patent is extended or adjusted under 35 U.S.C. 154(b) by 245 days.

(21) Appl. No.: 10/182,405

(22) PCT Filed: Feb. 14, 2001

(86) PCT No.: PCT/FR01/00418

§ 371 (c)(1),
(2), (4) Date: Jul. 29, 2002

(87) PCT Pub. No.: WO01/60713

PCT Pub. Date: Aug. 23, 2001

(65) Prior Publication Data

US 2003/0015541 A1 Jan. 23, 2003

(30) Foreign Application Priority Data

Feb. 15, 2000 (FR) ..... 00 01833

(51) Int. Cl.[7] ..... B65D 85/30
(52) U.S. Cl. ..... 220/1.5; 206/593; 206/594
(58) Field of Search ..... 206/3, 593, 594, 206/591, 521, 585; 220/1.5; 428/117, 116, 323

(56) References Cited

U.S. PATENT DOCUMENTS

| | | | | | |
|---|---|---|---|---|---|
| 386,696 | A | * | 7/1888 | Elwell | 217/27 |
| 3,054,524 | A | * | 9/1962 | Casten | 220/62.18 |
| 3,072,022 | A | * | 1/1963 | Wood et al. | 89/1.806 |
| 4,423,802 | A | | 1/1984 | Botzem et al. | |
| 4,566,588 | A | * | 1/1986 | Kataczynski | 206/3 |

FOREIGN PATENT DOCUMENTS

| | | |
|---|---|---|
| WO | WO 93/00845 | 1/1993 |

* cited by examiner

*Primary Examiner*—Stephen Castellano
(74) *Attorney, Agent, or Firm*—Pearne & Gordon LLP

(57) ABSTRACT

The shock-absorbing wall structure can be used to equip transport containers which may suffer major falls, generating very high energy on impact.

It is chiefly made up of several layers of a cellular bearing structure ($7$, $7_N$, $7_{N+1}$ . . . ) in which some metal blocks are regularly placed. These blocks are positioned in staggered manner from one layer to another, so as to leave regular spaces in which they can expand in the event of impact.

Particular application to transport containers such as fuel rods from nuclear plants or so-called type C containers (Transport Regulations for Hazardous Materials—Edition 96—IAEA Document, Vienna).

7 Claims, 3 Drawing Sheets

HIGH ENERGY SHOCK ABSORBING WALL STRUCTURE AND CONTAINER USING SAME

DESCRIPTION

1. Technical Field

The area of the invention is the transport of objects by container, that is to say whenever it is necessary to take precautions to provide against damage to transported objects. In particular, the invention concerns containers forming a specific protective casing resistant against various forms of aggression which transport packages may undergo when travelling, falls for example.

2. Prior Art and Problem Raised

For the transport of various objects, such as objets d'art, fragile objects or objects whose deterioration could cause risks for the environment, transport containers are known to be used which have shock-absorbing walls or parts which, in the event of fall or impact, absorb the energy from the impact preventing the object or objects from being damaged.

A distinction is routinely made between three categories of containers, which are:

"Low-energy" type containers intended to withstand falls from a height of less than one metre. If V is the velocity of the package at the time of impact, ($V<5$ m/s). In this category of containers, mass weights are generally less than one tonne. Therefore, the impact energy is less than one kilojoule. Within this category are containers proportioned to withstand inevitable handling-related falls, irrespective of type. The impact is generally absorbed by a shock-absorbing device in compressible material of elastomer type, positioned inside or outside the container. The crushing of this material protects the object being transported.

"Medium-energy" type containers must withstand falls from a height of more than one metre ($V>5$ m/s). In this type of container, the mass of the container with its content may reach several tonnes and the impact energy lies between one kilojoule and one megajoule.

In this category are containers proportioned to withstand accidental falls related to the handling of the objects being transported. The structure of the container is proportioned so that it can undergo substantial deformation on impact from the fall so as not to damage the transported object. In addition, it is necessary to add a shock-absorber to limit the impact transmitted to the object. This shock-absorber is placed inside or outside the container and is in deformable material, wood or balsa for example.

"High-energy" type containers must be able to withstand falls from a height of more than around ten metres ($V>10$ m/s). Package mass may reach several dozen tonnes and the impact energy is more than one megajoule. In this category are containers proportioned to withstand accidental falls during air transport. The structure of this type of container must able to undergo reasonable deformation on impact from the fall so as not to damage the contained object. This type of container requires the use of a shock absorber to limit as far as possible the effect of the impact on the transported object. There being no material with stiffness intermediate between wood and metal, this generally leads to choosing wood as the default shock-absorbing material. Since wood has a relatively low compression point, the proportioning of this type of container leads to substantial wood thicknesses possibly exceeding one metre so that its crushing is not totally completed at the end of impact. If this were not the case, there would be no shock absorber at the end of impact.

The main purpose of the present invention is, in this latter category of "high-energy" type containers, to propose shock absorbing walls or structure that are midway between solutions using wood and those using metals. In addition, it is desired to make available a modular shock-absorbing system that is adjustable in relation to container size, to the size of the contained object and to impacts.

Document WO-93 00845 describes a shock-absorbing structure. It is chiefly made up of one or more layers formed of at least one flat plate on which a second folded plate is applied or positioned, so as to form polygonal blocks similar to the cavities used to store eggs. It is mentioned that the insides of these hollow blocks may be filled with gas or elastic material and that these blocks may return to their initial shape after deformation.

SUMMARY OF THE INVENTION

For this purpose, the first main subject of the invention is a high energy impact shock-absorbing wall structure formed chiefly of a bearing structure in which metal blocks are positioned at regular intervals, the distribution of the blocks in the bearing structure depending upon desired crush resistance. This crush resistance is also defined in relation to transport conditions and the objects being transported.

In its preferred embodiment, the bearing structure is cellular, the blocks being placed in some of the cells.

In this patent document, the term "block" is used to express a solid, hard part which projects beyond two surfaces of the bearing structure between which this part is placed.

Preferably, this cell-like bearing structure is a honeycomb structure.

One of the materials chosen to produce this honeycomb bearing structure is aluminium.

In one special embodiment of the bearing structure, several superimposed honeycombed layers are used, the blocks being staggered relative to one another and from one layer to the other.

A second main subject of the invention is a transport container which must withstand major falls and comprising at least one wall formed, at least in part, of a wall structure defined in the preceding paragraphs to deaden high energy impacts.

One particular embodiment of this container is provided for the transport of elongated objects, such as fuel rods from nuclear plants.

In this case, the container is in the shape of a cylindrical body, closed at both ends, whose end walls are covered by a structure such as defined in the above paragraphs.

A securing lid may cover and hold in place each shock-absorbing structure.

LIST OF FIGURES

The invention and its preferred embodiments will be better understood on reading the following description accompanied by several figures respectively showing:

FIG. 1, a section view, showing the principle of a global protection transport container;

DETAILED DESCRIPTION OF AN EMBODIMENT OF THE INVENTION

Figure 1:
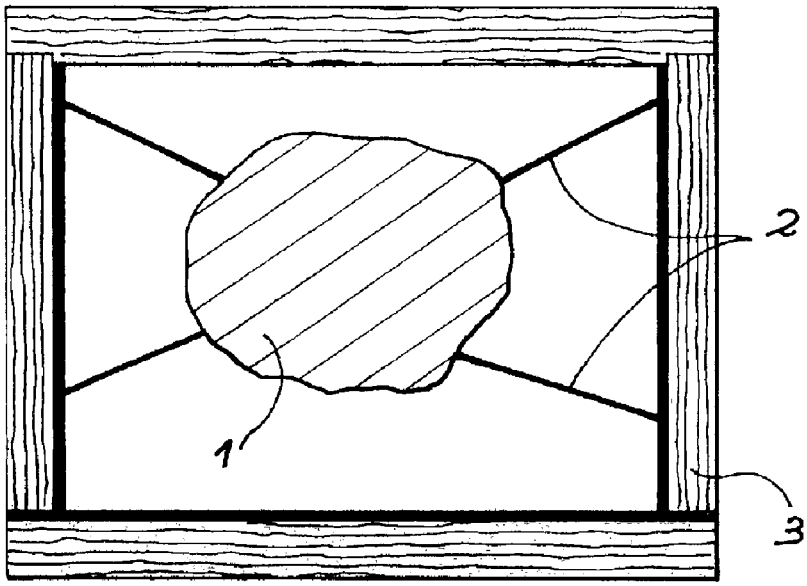

FIG. 1, a section view, shows a container of high energy type according to the invention. It mainly comprises a rigid structure 3 made up of several relatively thick walls and forming a crate or closed box. Inside there are wedging elements 2 to immobilise the object to be transported 1 positioned in the centre of the container in optimal manner.

Figure 2:
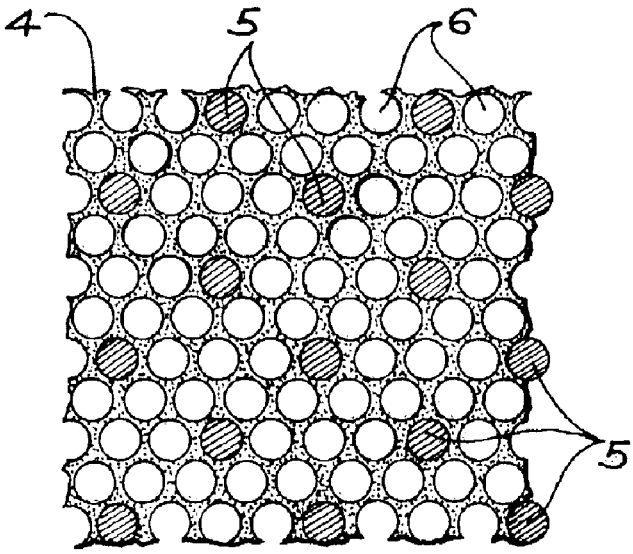
FIG. 2 is a diagram of block distribution in the honeycomb structure of the invention.

With reference to FIG. 2, the wall structure of the invention is chiefly made up of a cellular bearing structure 4, hexagonal for example, of honeycomb type.

This bearing structure 4 is in metal, aluminium for example, and is therefore not of heavy weight having regard to the large number of empty spaces formed by the cells 6. Its function is to hold the blocks 5 in place which are distributed uniformly throughout the entire bearing structure 4. In the case shown in FIG. 2, blocks 5 are arranged in a row so that these blocks 5 are uniformly distributed, for example so that each block 5 is separated from another by three empty cells 6. The occupation rate obtained is therefore in the order of 15%. This depends upon the surface area of the blocks relative to total surface area.

It is easy to understand that the density of blocks 5 in the bearing structure 4 is dependent upon several parameters relative to the conditions under which any container falls may occur.

The impact of the container on the ground or on a any obstacle depends upon the mass M of the container and of the object to be protected, on the velocity of impact V, on the crush working surface S of the container and on the acceptable crushed thickness T of the shock absorber. The shock absorbing surface may be characterized by an ideal plastic compression point $\sigma_{pt}$ on crushing. The structure of the container and the object to be protected must be able to withstand an acceleration $\gamma_{max}$ with no unacceptable deformation. Using the two following approach formulas:

$$\gamma_{\max} = \frac{\sigma_{\mathrm{pt}} \times S}{M}$$

$$\sigma_{\mathrm{pt}} = \frac{M \times V^2}{2 \times S \times T}$$

it is possible to determine the range of values to define the plastic point of the shock-absorbing material to be used. It is therefore deduced that $\sigma_{pt}$ lies between 25 and 300 megapascals.

Also, a surface occupation rate is defined, or filling rate, of the cellular structure:

$$\alpha = \frac{S \text{ of shock-absorbing blocks}}{\text{Container working surface } S}$$

which, moreover, corresponds to the density of the blocks. For a surface occupation rate $\alpha$ between 1/100 and 90/100, the plastic compression point $\sigma_{pt}=\sigma_e \times \alpha$, in which $\sigma_e$ is the elastic stress limit of the material forming the shock-absorbing blocks, hence $$0.01\sigma_e < \sigma_{pt} < 0.90\sigma_e$$

(The compression point of the structure is not taken into account).

With a wide range of materials and by adapting the occupation rate to fall or impact conditions, it is possible to choose a shock-absorbing material having the desired characteristic value of $\sigma_{pt}$.

Figure 3:
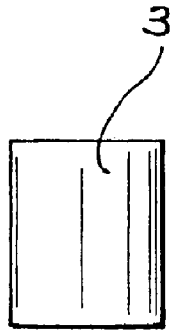
FIG. 3 shows a block used in the honeycomb structure of the invention.

With reference to FIG. 3, the blocks 5 are in metal and may be of cylindrical shape. It is also possible to consider using spherical shapes or shapes adapted to the shape of the cells 6 of the honeycomb bearing structure. The height, or in general the size of blocks 5 is adjusted in relation to the local forces generated by crushing on impact. Lead, tin, steel, titanium are among the numerous metals which may be used in this type of wall. The choice of metal is determined, among others, according to the pre-existing structure of the container and to secondary or optional uses of the shock-absorbing wall, for example a "radiator" function contributing towards heat exchange.

Figure 4:
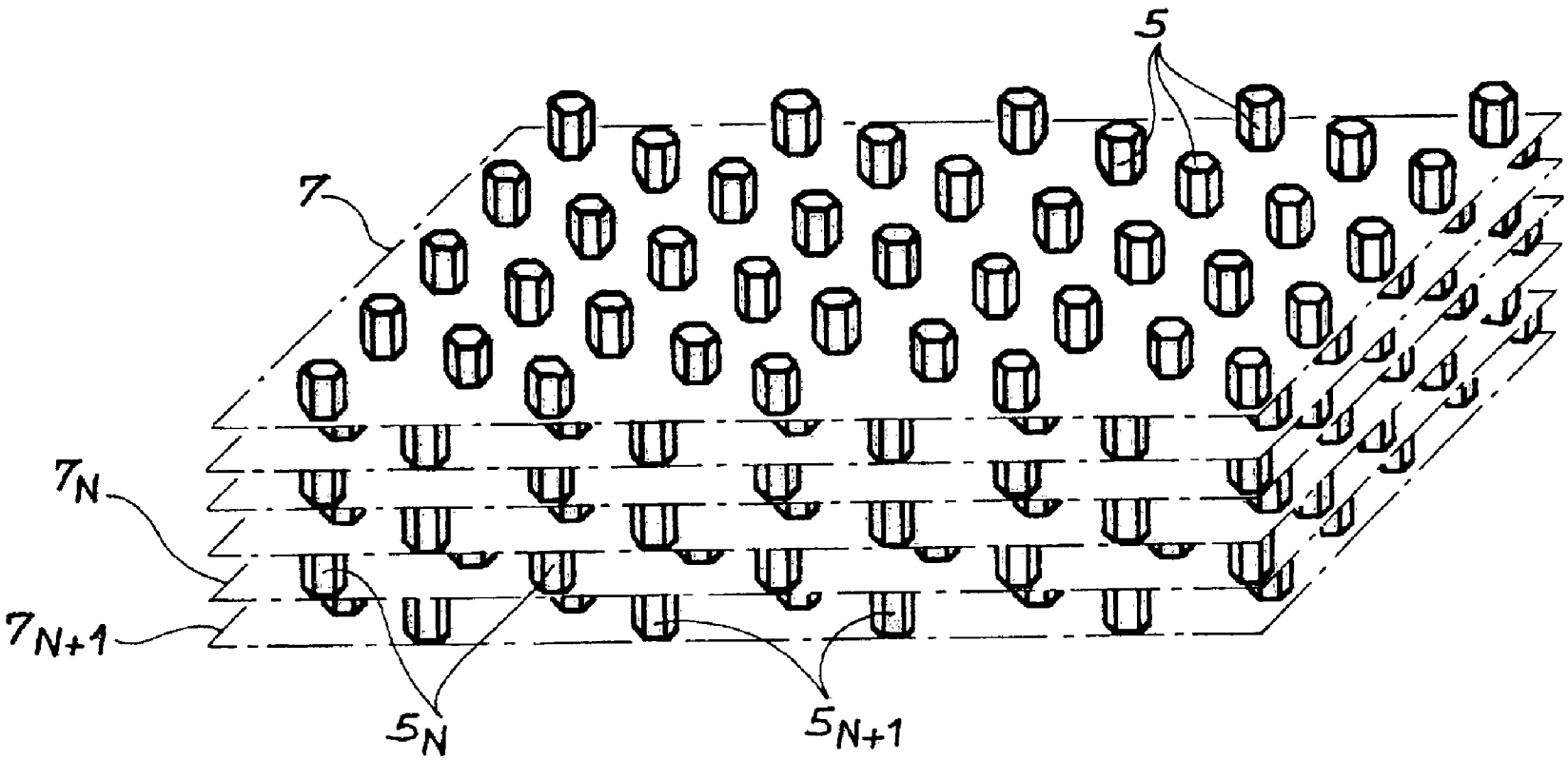
FIG. 4 is an oblique view of an embodiment of the structure of the invention in several layers.

With reference to FIG. 4, one advantageous embodiment of the shock-absorbing structure of the invention is made up of several layers. More precisely, several layers $\mathbf{7}_N$, $\mathbf{7}_{N+1}$, . . . of bearing structures symbolised by plates drawn in chain-dotted lines are superimposed. They each contain a certain number of blocks 5, regularly distributed in the manner previously explained. It is to be noted that the blocks $\mathbf{5}_N$ of a layer $\mathbf{7}_N$ must not be superimposed over the blocks $\mathbf{5}_{N+1}$ of layer $\mathbf{7}_{N+1}$ or of directly adjacent layers. On the contrary, it is essential to stagger blocks $\mathbf{5}_{N+1}$ in each layer $\mathbf{7}_{N+1}$ relative to the positioning of blocks $\mathbf{5}_N$ of adjacent layer $\mathbf{7}_N$. In this way, blocks $\mathbf{5}_N$ of layer $\mathbf{7}_N$ are staggered in relation to blocks $\mathbf{5}_{N+1}$ of directly adjacent layer $\mathbf{7}_{N+1}$ by a distance that is one half of the distance between blocks $\mathbf{5}_N$. Therefore, at the time of an impact, causing full or partial crushing of the shock-absorbing structure, the blocks $\mathbf{5}_N$ will tend to deform layer $\mathbf{7}_{N+1}$ positioned immediately behind at a point where there is no block $\mathbf{5}_{N+1}$ carried by this layer. In reciprocal manner, blocks $\mathbf{5}_{N+1}$ will tend to deform layer $\mathbf{7}_N$ located just in front since no block $\mathbf{5}_N$ will be positioned directly opposite.

Therefore, the characteristics of the shock-absorbing structure so formed result from the stacking of a certain number of layers $\mathbf{7}_N$, $\mathbf{7}_{N+1}$, $\mathbf{7}_{N+é}$, . . . and from the distribution of blocks $\mathbf{5}_N$, $\mathbf{5}_{N+1}$, $\mathbf{5}_{N+1}$, . . . placed in each layer.

In the case of application to a container, its protection may be solely local when the direction of impact is known in advance. Therefore, it is possible to consider only covering part of the surfaces of the container with a shock-absorbing structure of the invention.

Figure 5:
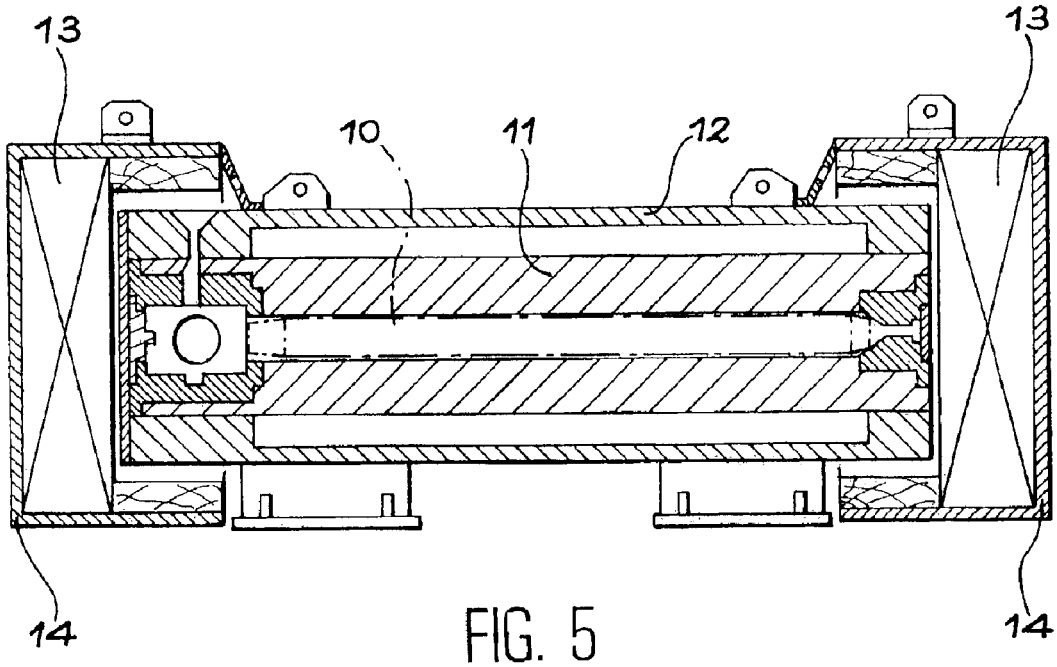
FIG. 5 is a section view showing the application of the structure of the invention to a container intended to transport an elongated object.
Figure 6:
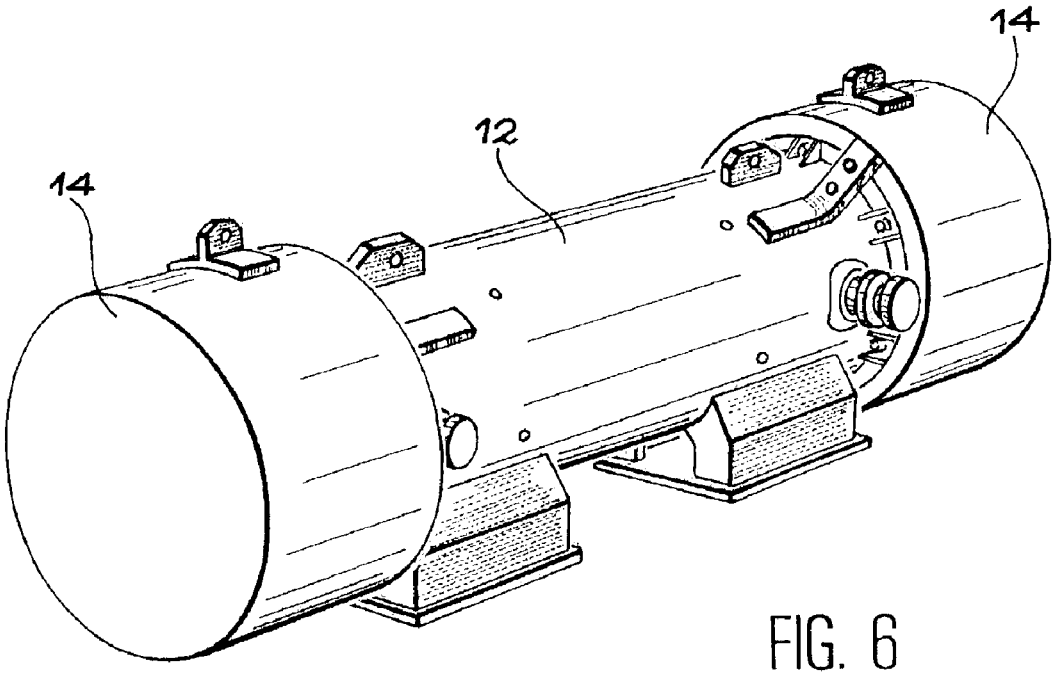
FIG. 6 is an oblique view of the container shown in FIG. 5.

For example, with reference to FIG. 5, consideration is given to constructing a container able to transport an elongated object 10 whose length exceeds several metres. In this case, the specifications require impact resistance at a speed of 90 meters/second, the total mass of the container and its object being in the order of 20 tonnes, the diameter of impact being in the order of 2 metres. This container mainly comprises a casing 11, in which the object 10 is placed, preferably doubly protected by an outer body 12. The assembly is closed at its ends. Each of the ends is covered with a determined thickness of the shock-absorbing structure defined previously and denoted 13. The latter may optionally be covered with a securing lid 14. With this container, using thirty layers of the previously described wall structure, having a block occupation rate of approximately 30%, the diameter of the blocks being in the order of 5 mm and their height approximately 10 mm, the effective crushing obtained is approximately 20 cm. In other words, the thickness of the protective layer being 30 cm, it is reduced to a thickness of 10 cm after impact. Conjointly, the deformation of these blocks due to resultant acceleration in the order of 2 500 g concomitantly causes an increase in the diameter of each block. On this account the blocks tend to occupy most of the free space beforehand.

It will be easily understood that heavy containers may suffer major falls with very high speeds, greater than 100 meters/second.

The modular nature of the bearing structures used in the structure of the invention, such as honeycomb plates, makes it easy to change the block occupation rate or the nature of the blocks. The compression characteristic $\sigma_e$ of the material with which the blocks are made and block thickness can therefore be adjusted to attain the desired plastic compression point $\sigma_{pt}$.

What is claimed is:

1. High energy impact shock-absorbing wall structure, chiefly made up of a bearing structure (4) in which metal blocks (5, $5_N$, $5_{N+1}$) are regularly distributed, the density of the blocks in the bearing structure (4) being dependent upon desired crush resistance, characterized in that the bearing structure (4) is a structure with several superimposed cellular layers (7, $7_N$, $7_{N+1}$, . . . ), the blocks (5, $5_N$, $5_{N+1}$, . . . ) being staggered relative to one another and from one layer to another.

2. Shock-absorbing wall structure according to claim 1, characterized in that the bearing structure (4) comprises a plurality of cells (6), the blocks (5, $5_N$, $5_{N+1}$) being placed in some of the cells (6) of the bearing structure (4).

3. Shock-absorbing wall structure according to claim 1, characterized in that at least one of the cellular layers of the bearing structure (4) is a honeycomb structure.

4. Shock-absorbing wall structure according to claim 1, characterized in that the bearing structure (4) comprises aluminum.

5. Transport container which must withstand major falls, comprising at least one wall formed at least in part of a wall structure according to any of claims 1 to 4 to deaden high energy impacts.

6. Transport container according to claim 5, intended to transport an elongated object (10), formed of a cylindrical body (11) closed at its two ends, characterized in that the high energy impact shock-absorbing wall structures are walls (13) each covering one end of the cylindrical body (11).

7. Transport container according to claim 6, characterized in that it a comprises a lid (14) covering the shock-absorbing wall structures.

* * * * *